United States Patent [19]

Schwarzmann

[11] 4,275,366

[45] Jun. 23, 1981

[54] PHASE SHIFTER

[75] Inventor: Alfred Schwarzmann, Mt. Laurel, N.J.

[73] Assignee: RCA Corporation, New York, N.Y.

[21] Appl. No.: 68,503

[22] Filed: Aug. 22, 1979

[51] Int. Cl.[3] ..... H01P 1/185; H01P 3/08

[52] U.S. Cl. ..... 333/161; 333/156; 333/164

[58] Field of Search ..... 333/156, 157, 160, 161, 333/164

[56] References Cited

U.S. PATENT DOCUMENTS

| | | | |
|---|---|---|---|
| 3,491,314 | 1/1970 | White | 333/164 |
| 3,504,375 | 3/1970 | Beaugrand et al. | 333/160 |
| 3,568,105 | 3/1971 | Felsenheld | 333/161 |
| 3,876,963 | 4/1975 | Graham | 333/202 |
| 3,916,349 | 10/1975 | Ranghelli et al. | 333/156 X |
| 4,021,755 | 5/1977 | Svensson | 331/96 |
| 4,105,959 | 8/1978 | Stachejko | 333/164 X |

FOREIGN PATENT DOCUMENTS

| | | | |
|---|---|---|---|
| 1325331 | 8/1973 | United Kingdom | 333/157 |

OTHER PUBLICATIONS

Wallington-"Microstrip Switching Using P-I-N Diodes", GEC Journal of Science and Technology, vol. 43, No. 3, 1977; pp. 136-144.

*Primary Examiner*—Marvin L. Nussbaum
*Attorney, Agent, or Firm*—Samuel Cohen; Robert L. Troike; Robert Ochis

[57] ABSTRACT

A phase shifter comprises a transmission line having a second terminated transmission line extending therefrom. A single diode is coupled across the second transmission line. The diode is switched between two operating states which changes the effective electrical length of the second transmission line and introduces a phase shift to a signal propagating in the first transmission line.

8 Claims, 8 Drawing Figures

PHASE SHIFTER

Phased array radar systems generally comprise a plurality of radiating elements each of which generally has a phase shifter associated therewith. In the transmit mode the phase shifters determine the direction of the radiated beam emitted by the radar and by electronically changing the amount of phase shift produced by these phase shifters the beam can be made to scan a preselected spatial volume. In practice, the transmitted beam scans a spatial volume in incremental steps, the scanning accuracy of a given volume is dependent upon the size of the incremental step or the phase shift per step of the phase shifters.

The resolution of a received signal in a phased array radar is dependent upon the size of the incremental steps of the phase shifter since the phase error between adjacent elements is usually a fixed percentage of the magnitude of the bit of the phase shifter. A given radiated beam has side lobes caused by these errors. These side lobes reduce the energy contained in a transmitted beam and decrease the signal to noise ratio in the received return. Hence, one method of increasing the energy in the main transmitted beam and increasing the signal to noise ratio of the signal received is to reduce the phase shifter errors between adjacent elements. This can be effectively accomplished by reducing the magnitude of the incremental step of the phase shifter. However, if one reduces the magnitude of the steps, more steps are needed to provide the proper amount of total phase shift from the phase shifter. Unfortunately, this increase in steps escalates the cost of each phase shifter since each step conventionally contains between two and four diodes. It is therefore quite desirable to design a single diode, small bit size phase shifter.

A phase shifter, embodying the principles of the present invention is capable of introducing relatively small phase shifts and using only a single diode switch.

In the drawing, which is not drawn to scale:

Figure 1:
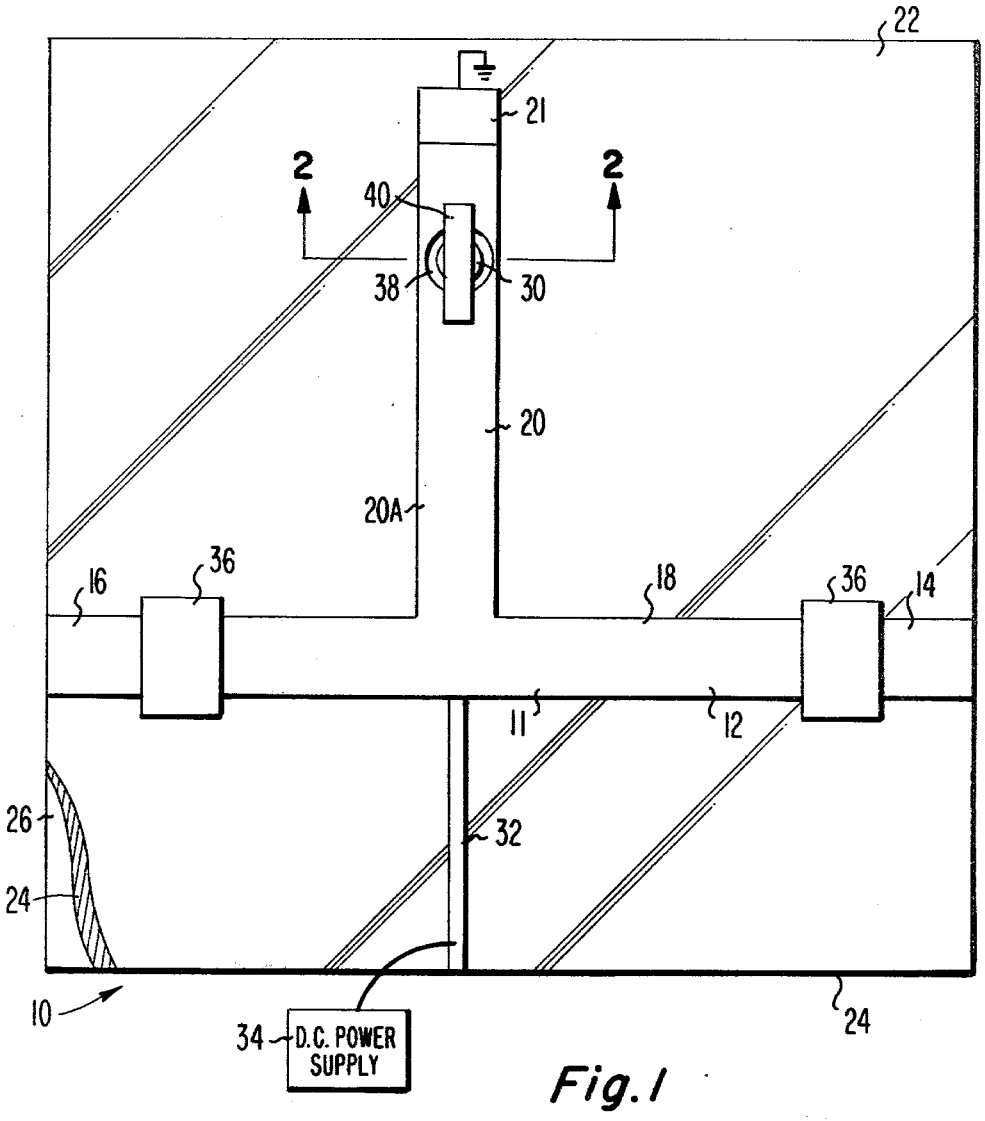
FIG. 1 is a partially cutaway plan view of a diode phase shifter embodying the principles of the present invention.

Referring to FIG. 1, the single diode phase shifter 10 is shown using microstrip transmission line, although it could instead be fabricated utilizing coaxial cable, waveguide, or the like. As is well known, a microstrip transmission line circuit comprises a comparatively narrower conductor on one surface of a dielectric substrate and a comparatively wider ground plane conductor, on the opposite surface of that substrate. Conventionally, the ground plane conductor covers the entire opposite surface. The phase shifter 10 includes a first narrow conductor 11 having an input section 14 and a second section 16 which may serve as an output section. The first narrow conductor 11 also includes a third section 18 coupling the input section 14 to the second section 16. In addition, the phase shifter 10 includes a narrow stub conductor 20, one end of which is connected to the third section 18 of the first narrow conductor 11, the other end of which, for reasons discussed below, is connected via a bypass capacitor 21 to a ground plane conductor 26. The first narrow conductor 11, and the stub conductor 20 are formed on one surface 22 of an electrically insulating substrate 24. A layer of conductive material serving as a ground plane conductor 26 is formed on the opposite, parallel surface 28 of the substrate 24. The narrow conductor sections, 14, 16 and 18 on the one surface 22 of the substrate 24 form with the ground plane conductor 26 a first microstrip transmission line 12. The narrow stub conductor 20 forms also with the ground plane conductor 26 a second microstrip transmission line 20A.

Figure 2:
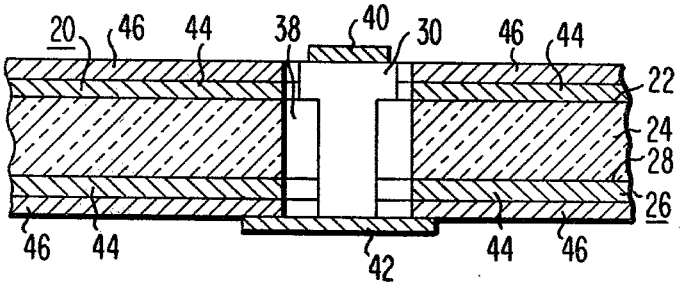
FIG. 2 is a partial cross-sectional view of the phase shifter shown in FIG. 1 taken along the line 2—2 thereof.

The effective electrical length of the stub transmission line 20A is electronically switched between a comparatively effectively shorter electrical length and a comparatively effectively longer electrical length. The switching is accomplished by means of a diode 30 placed between the conductor 20 and the ground plane 26 at a preselected point along the stub transmission line 20A. The mounting of the diode 30 is shown in some detail in FIG. 2. Referring to FIG. 2, diode 30 is shown positioned in an opening 38 through the substrate 24 and one of its electrodes is connected to the stub conductor 20 via a gold, copper or the like, strip 40. The diode 30 is connected at its other electrode to the ground plane conductor 26 via a similar strip 42. The diode 30 can be poled in either direction, i.e. either the anode or the cathode can be connected to the ground plane conductor 26.

In addition to the above elements, the phase shifter 10, according to the precepts of the present invention, also contains a D.C. bias line 32 which is shown connected to the third section 18 of the narrow conductor 11 of the transmission line 12 at one end and connected to a means 34 for controlling the state of the diode 30 at the other end. Such a means 34 may include a regulated power supply which is capwble of providing a D.C. voltage at two different levels, one for forward biasing the diode 30 and causing it to operate as a short circuit and the other voltage level for reverse biasing the diode 30 and causing it to operate as an open circuit. The D.C. voltage is isolated from the input and second sections, 14 and 16 respectively, of the transmission line 12 by blocking capacitors 36 connected between the respective ends of the third section 18 of the narrow conductor. The D.C. bias voltage is also isolated from the ground plane 26 by a D.C. blocking capacitor 21. The D.C. blocking capacitor 21 can be connected to the ground plane 26 by known techniques such as a thin film wrap-around or by a through-the-substrate opening directly beneath the capacitor 21, not shown in the drawings.

In a specific example, the phase shifter 10 has a specified bandwidth of 10 percent centered around a center frequency, $f_0$ of 3 GHz. The substrate 24 is alumina ($Al_2O_3$) about 0.13 centimeters thick having an effective dielectric constant of about 6.7. The first transmission line 12 and the second, or stub, transmission line 20A preferably have an impedance of about 50 ohms, which is conventional in the industry of microwave microstrip circuits. It will be understood however that the second transmission line 20A may be of a lower or higher impedance than the first transmission line 12. Preferably, the conductors 14, 16 and 18, the stub conductor 20, the D.C. bias line 32 and the ground plane conductor 26 comprise multiple layers of electrically conductive material. In this instance, as particularly shown in FIG. 2, the conducting elements comprise a first layer 44 of molybdenum about 200 Å thick in contact with the substrate 24 and a second layer 46 of gold about 13 micrometers thick on the layer 44 of molybdenum. The width of the conductors 14, 16 and 18 and the stub conductor 20 are about 0.12 centimeters to yield an impedance of about 50 ohms.

The stub conductor 20 and hence the length of the second transmission line 20A is designed to be a quarter wavelength ($\lambda_0/4$) long of the center frequency, $f_0$. In this example, the stub 20 is therefore about 1.3 centimeters long. The diode 30 is positioned such that, when it is forward biased, i.e. when it appears as a relatively low impedance to ground, it effectively decreases the effective electrical length of the second transmission line 20A. The effect of such a location is more fully discussed below but suffice it to say at this time that in this example, the diode 30 is positioned a distance of between about 0.5 to 1.3 centimeters from the connection of the stub 20 to the first transmission line 12.

The diode 30 is preferably a PIN diode although other diodes can also be used. One particular diode which has been found to be especially useful is the Type No. 7900 device manufactured and marketed by Unitrode Corp., of Watertown, Mass.

The phase shifter 10 described above can be viewed as having two operating states. In the first operating state, the diode 30 is reverse biased and operates as an open circuit, that is, it operates as a very high impedance between the stub conductor 20 and the ground plane conductor 26. In this case, a signal having a frequency of $f_1$ propagating along the first transmission line 12 is substantially completely unaffected by the presence of the stub conductor 20. That is, any energy entering the second transmission line 20A is effectively completely reflected and returned to the first transmission line 12 as if the stub conductor 20 were not present. The amplitude and phase response of a broadband signal propagating through the phase shifter 10 while the diode 30 is in the open state are graphically depicted, at 52 and 50 respectively, in FIGS. 3A and 3B, respectively.

In the second operating state the diode 30 is forward biased and effectively operates as a short circuit between the stub conductor 20 and the ground plane conductor 26. In this state, the effective electrical length of the stub 20 is that distance between its connection to the main transmission line 12 and the diode 30. The portion of the second transmission line 20A distal from the first transmission line 12 and beyond the diode 30 is effectively out of the circuit of the phase shifter 10. In this diode state the stub conductor 20 appears to have an effective electrical length which is a quarter wavelength of a second frequency $f_2$. The amplitude and phase response of a broadband signal propagating through the phase shifter 10 while the diode 30 is in this shorted state is graphically depicted at 48 and 54, respectively, in FIGS. 3A and 3B, respectively.

Figure 3A:
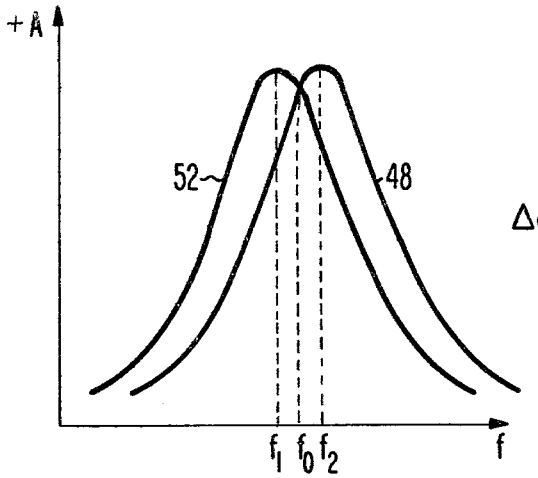
FIG. 3A is a graphic representation of the amplitude versus frequency response of the phase shifter shown in FIG. 1.

Referring to FIG. 3A it is readily observed that while the peak amplitude of the broadband signal, that is, the maximum amplitude response at the frequency at which the stub conductor 20 is exactly a quarter wavelength long, shifts depending upon the state of the diode 30. However, the amplitude of the signal, i.e. the energy transmitted through the first transmission line 12, hardly varies. It has been found that so long as $f_2$ and $f_1$ are within the required 10 percent bandwidth of the phase shifter 10, the amplitude response of the signal at the output can be considered flat or substantially unchanged.

Figure 3B:
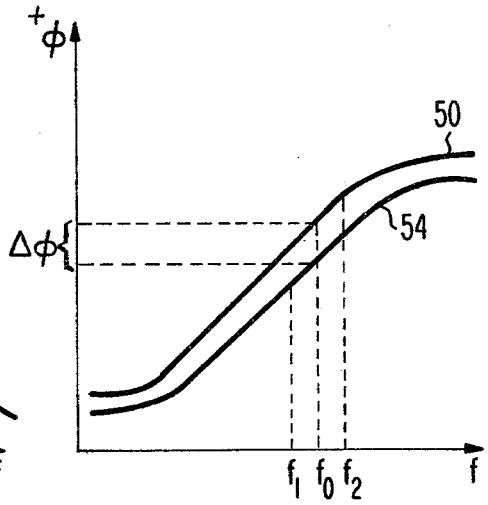
FIG. 3B is a graphic representation of the phase versus frequency response of the phase shifter shown in FIG. 1.

Referring to FIG. 3B it is observed that there is a significant phase shift or $\Delta\phi$ in the signal response for the two operating states of the diode 30. The size of the $\Delta\phi$ is directly dependent upon the difference between the resonant frequencies which is in turn directly dependent upon the effective electrical length of the second transmission line 20A. As noted above, the effective electrical length of the second transmission line 20A is dependent upon the location therealong of the diode 30. Hence, there is a readily determinable relationship between the position of the diode 30 along the second transmission line 20A and the resultant phase shift, $\Delta\phi$, of the two operating states.

The phase shift can be designed to be quite small by locating the diode 30 close to the end of the second transmission line 20A distal from the first transmission line 12. For example, if a phase shift, $\Delta\phi$, of 2.8 degrees is desired, and assuming that parameters set out above, i.e. $f_0=3.0$ GHz in a 50Ω system, one can determine that a $\Delta f$ or $(f_1-f_2)$ of 0.4 GHz is necessary to achieve the $\Delta\phi=2.8°$ and that $f_1$ should therefore be equal to about 2.8 GHz. Thus, the effective electrical stub length of 90°, i.e., $\lambda_1/4$, which is an effective quarter wavelength at $f_1$, is required to obtain the curve 52 of the amplitude response shown in FIG. 3A. This response is obtained by locating the diode 30 along the second transmission line 20A an electrical distance of about 70° from the connection between the stub conductor 20 and the first transmission line 12. Thus, when the diode 30 is open the amplitude and phase response depicted by curves 52 and 50 is obtained and when the diode 30 is shorted the amplitude and phase response depicted by curves 48 and 54 is obtained. When the diode 30 is thus located, the phase shifter 10 can be considered to be a 2.5° phase shift bit, a phase shift bit being a circuit which introduces an incremental phase change.

Figure 4:
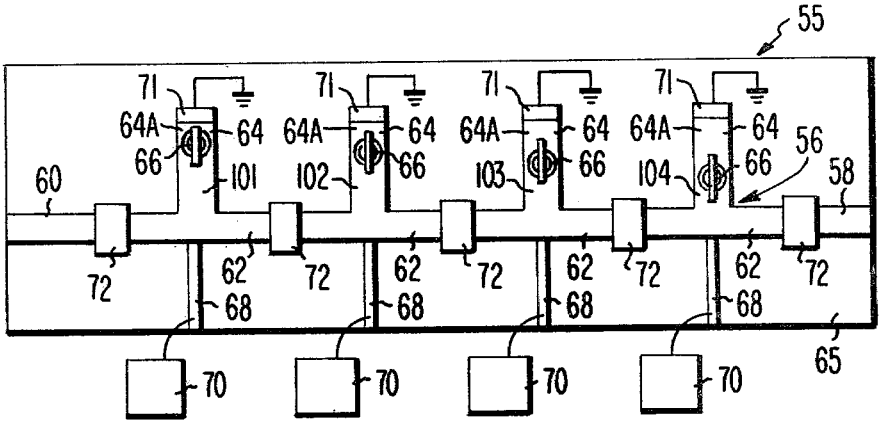
FIG. 4 is a plan view of a multiple bit diode phase shifter also embodying the principles of the present invention.

Referring to FIG. 4 which illustrates a second embodiment of the invention, a multiple bit phase shifter system 55 is shown having a first transmission line 56 having an input narrow conductor section 58 and a second narrow conductor section 60 which may serve as an output section. The phase shifter 55 includes a plurality of serially connected third narrow conductor sections 62 of the first transmission line. Each third narrow conductive section 62 has a narrow stub conductor 64 connected thereto and extending therefrom. The narrow conductors 58, 60 and 62 are on one surface of a dielectric substrate 65 and a ground plane conductor covers the opposite surface of the substrate 65 to form the first microstrip transmission line 56. The narrow stub conductors 64 on the one surface of the substrate 65 each form a second transmission line 64A. Each second transmission line 64A has a diode 66 located thereacross with one electrode of the diode connected to the ground plane and the other electrode of the diode connected to the narrow stub conductor 64. Each stub conductor 64 has a D.C. bias line 68 associated therewith. Each bias line 68, as shown in FIG. 4 connected between the associated one of the third sections 62, and a bias control power supply 70. The phase shifter system 55 also includes a plurality of D.C. blocking capacitors at the terminating end 71 between the stub conductors 64 and the ground plane and D.C. blocking capacitors 72 isolating each third narrow conductor section 62 from each other section 62 and from the input narrow conductor section 58 and the second narrow conductor section 60.

As shown, each diode 66 can be positioned along its stub conductor 64 at a different distance from the third narrow conductor section 62. Thus, if each stub conductor 64 is designed to be an effective quarter wavelength at the center frequency $f_0$, and if the signal response of the phase shifter system 55 when the diodes 66 are open is considered a reference for each second transmission line 64A, then when the diode 66 associated therewith is switched to a shorted state, it will introduce a different phase shift to the reference signal. The effect of the more than one phase shift bit being introduced is cumulative throughout the phase shifter system 55. For example, the diode 66 is located near the terminating end 71 of stub conductor 101 to introduce a phase change of 2.8° as previously described. The diode 66 associated with stub conductor 102 is at a point closer to the third narrow conductor section 62 than the diode 66 associated with stub conductor 101 to introduce a greater phase shift. Similarly the diodes 66 associated with stub conductors 103 and 104 short these conductors at progressively shorter distances from the conductors 62 to introduce progressively greater phase shifts. These distances can be arranged so that the phase shifts of the stub conductor, 101, 102, 103 and 104, are integral multiples. That is, the phase shift of stub conductor 101 can be 2.8°, the phase shift of 102 can be 5.6°, that of 103 can be 11.2° and that of stub conductor 104 can be 22.4°.

As a practical matter, the phase shifters 10 and 55 are primarly designed for relatively small phase shifter increments such as 2.8°, 5.6°, 11.2°, or even 22.4°. This phase shifter system can provide a total phase shift of about 42°. Thus this particular phase shifter 55 can be used in conjunction with a conventional phase shifter having phase shifts of 45°, 90° and 180° to provide an overall phase shift capability of 360° in increments of 2.8°.

Figure 5:
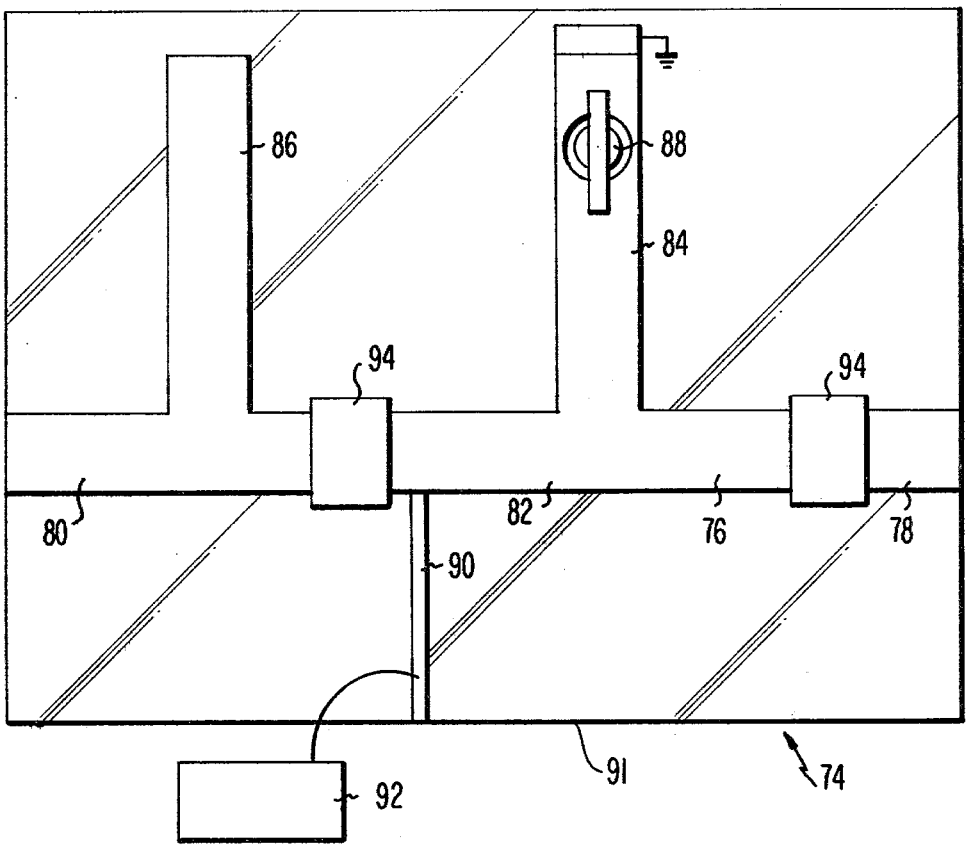
FIG. 5 is a plan view of yet another diode phase shifter also embodying the principles of the present invention.

Referring now to FIG. 5, which illustrates another embodiment of the present invention, phase shifter 74 is depicted as having a first transmission line 76 having an input narrow conductor section 78 and a second narrow conductor section 80 which may serve as an output section. Phase shifter 74 includes a third narrow conductor section 82 coupling the input section 78 to the second section 80. The narrow conductors are on one surface of a dielectric substrate 91. The opposite surface of the substrate 91 is covered with conductive material to form a ground plane conductor. The phase shifter 74 also includes a first stub conductor 84 on the first surface of the substrate 91 having one end connected to the conductor 82 and extending therefrom and a second stub conductor 86 having one end connected to the conductor 82 and extending therefrom. The connections of the first and second stub conductors 84 and 86 respectively, to the conductor 82 are spaced apart by a quarter wavelength of the center frequency ($\lambda_0/4$). The stub conductors 84 and 86 form with the ground plane conductor microstrip transmission line stubs. Similar to the phase shifter 10, the first stub 84 has a diode 88 positioned therealong and connected between the conductor 84 and a ground plane on the opposite side of the substrate 91. As in the phase shifter 10 the phase shifter 74 includes a D.C. bias line 90 connected between the third section 82 and a means 92 for controlling the state of the diode. In addition, the phase shifter 74 includes D.C. blocking capacitors 94 which isolate the input narrow conductor section 78 and the conductor 80 from the D.C. bias supply.

Figure 6A:
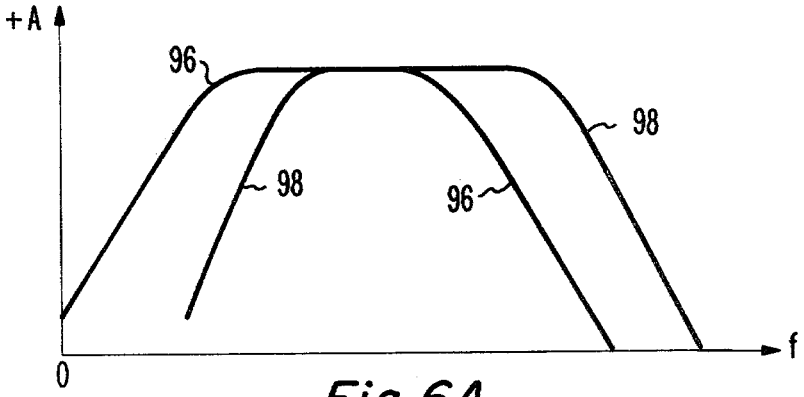
FIG. 6A is a graphic representation of the amplitude versus frequency response of the phase shifter shown in FIG. 5.
Figure 6B:
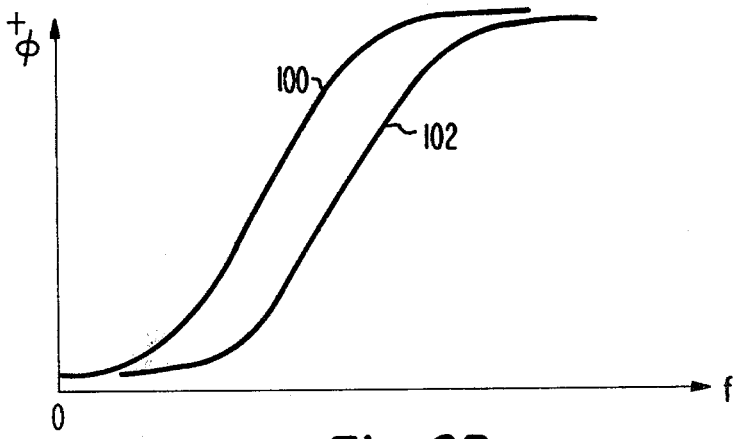
FIG. 6B is a graphic representation of the phase versus frequency response of the phase shifter shown in FIG. 5.

The major advantage of the phase shifter 74 is that the amplitude response for a given bandwidth is flatter than that of the phase shifter 10 because of the presence of the second stub 86. The amplitude and phase response for the two operating states of the phase shifter 74 are graphically depicted in FIGS. 6A and 6B. Referring to 6A it is clearly shown that the amplitude response 96 of the phase shifter 74 when the diode 88 is in an open state is considerably flatter than the same operating state of the phase shifter 10 having a single stub 20. The same is true for the amplitude response 98 when the diode 88 is shorted. The phase response curves, 100 and 102, of the phase shifter 74 for the diode open and diode shorted states, respectively, are included for completeness and to show that a viable phase shift, or $\Delta\phi$, is obtainable with this design. It is easily recognized that a multiple bit phase shifter can be fabricated using a plurality of bits designed similar to the phase shifter 74. Alternatively, a multiple bit phase shifter can include bits similar to both the phase shifter 10 and the phase shifter 74 as well as more conventional phase shift designs.

The phase shifters 10, 55 or 74 are single diode small bit size phase shifters, which, because of the small number of diodes required, are relatively inexpensive. Any one of these phase shifter systems 10, 55 or 74 can be utilized to increase the resolution of a phased array radar system by reducing phase errors between adjacent elements.

What is claimed is:

1. A microstrip phase shifter comprising:

a first transmission line having a characteristic impedance capable of sustaining an electromagnetic signal, said first transmission line having a preselected center frequency and exhibiting a characteristic phase response;

a second transmission line stub section having one end thereof connected to said first transmission line and the other end thereof terminated;

means for electronically varying the effective electrical length of said second transmission line whereby said phase response of said signal propagating along said first transmission line is incrementally changed; and a third transmission line stub section extending from said first transmission line, said third transmission line being spaced apart along said first transmission line from said second transmission line by about a quarter wavelength of said center frequency and having a fixed electrical length.

2. A phase shifter as claimed in claim 1 wherein said means comprises:

a diode across said second transmission line; and means for switching said diode between open and shorted states to change the effective electrical length of said second transmission line.

3. A phase shifter as claimed in claim 1 or 2 wherein said second transmission line and said third transmission line each have a characteristic impedance about equal to said characteristic impedance of said first transmission line.

4. A phase shifter as claimed in claim 1 wherein said third transmission line extends about a quarter wavelength of said center frequency from said first transmission line.

5. A microstrip phase shifter comprising:

a first transmission line having a characteristic impedance capable of sustaining an electromagnetic signal having a preselected center frequency, said first transmission line including:

an input section of transmission line to which said signal may be applied;

an output section of transmission line; and a plurality of third sections of transmission line serially connected coupling said input section to said output section, each said third section having a second transmission line of variable electrical length extending therefrom and a third transmission line of fixed electrical length extending therefrom, said second and said third transmission lines of each said third section being spaced apart therealong by about a quarter wavelength of said center frequency; and means for individually electronically varying the effective electrical length of each said second transmission line.

6. A phase shifter as claimed in claim 5 wherein said means comprises a plurality of diodes, one associated with each said second transmission line wherein each diode is located along and connected across its associated second transmission line whereby when said diode is switched between its open and its shorted states the effective electrical length of its associated second transmission line is changed; and means for independently controlling the state of each of said plurality of diodes.

7. A phase shifter as claimed in claim 6 wherein each said diode is located at a different distance from the third section with which its second transmission line is associated.

8. A phase shifter as claimed in claim 5 wherein each said third transmission line extends from said third section about a quarter wavelength of said center frequency.

* * * * *